US012208933B2

(12) United States Patent
Holka

(10) Patent No.: US 12,208,933 B2
(45) Date of Patent: Jan. 28, 2025

(54) METHOD OF PRODUCING A PACKAGING CONTAINER, A PACKAGING CONTAINER AND A CURLING TOOL

(71) Applicant: AR Packaging Systems AB, Lund (SE)

(72) Inventor: Simon Holka, Staffanstorp (SE)

(73) Assignee: GPI Systems AB, Lund (SE)

( * ) Notice: Subject to any disclaimer, the term of this patent is extended or adjusted under 35 U.S.C. 154(b) by 0 days.

(21) Appl. No.: 17/784,303

(22) PCT Filed: Dec. 9, 2020

(86) PCT No.: PCT/SE2020/051184

§ 371 (c)(1),
(2) Date: Jun. 10, 2022

(87) PCT Pub. No.: WO2021/118441

PCT Pub. Date: Jun. 17, 2021

(65) Prior Publication Data

US 2023/0044438 A1 Feb. 9, 2023

(30) Foreign Application Priority Data

Dec. 12, 2019 (SE) ..... 1951440-5

(51) Int. Cl.
*B65B 43/10* (2006.01)
*B65B 1/02* (2006.01)
(Continued)

(52) U.S. Cl.
CPC ..... *B65B 43/10* (2013.01); *B65B 1/02* (2013.01); *B65B 1/04* (2013.01); *B65D 3/02* (2013.01); *B65D 3/14* (2013.01)

(58) Field of Classification Search
CPC .. B65B 43/10; B65B 1/02; B65B 1/04; B65B 7/2892; B65D 3/02; B65D 3/14;
(Continued)

(56) References Cited

U.S. PATENT DOCUMENTS 1,064,787 A 6/1913 Taylor
1,396,282 A 11/1921 Penn
(Continued)

FOREIGN PATENT DOCUMENTS

CH 280201 A 1/1952
CN 88102720 A 11/1988
(Continued)

OTHER PUBLICATIONS

Machine translation of JPS58216539A to Tomoo (Year: 1983).*
(Continued)

*Primary Examiner* — Thomas M Wittenschlaeger
*Assistant Examiner* — Himchan Song
(74) *Attorney, Agent, or Firm* — Womble Bond Dickinson (US) LLP

(57) ABSTRACT

The present disclosure relates to a method of forming a paperboard packaging container from a rectangular body blank, the method comprising the steps of providing a rectangular body blank having a first end edge and a second side edge, forming a tubular container body from the rectangular body blank, sealing together the first and the second side edge of the body blank, closing the first end opening by pressing a paperboard disc into the first end opening, pressing the first end of the tubular container body into a curl forming portion of a curling tool, filling the packaging container with bulk solids, and closing the second end opening.

5 Claims, 6 Drawing Sheets

(51) Int. Cl.
*B65B 1/04* (2006.01)
*B65D 3/02* (2006.01)
*B65D 3/14* (2006.01)

(58) Field of Classification Search
CPC . B31B 2120/004; B31B 50/594; B31B 50/73; B31F 1/0041; B31F 1/0009
See application file for complete search history.

(56) References Cited

U.S. PATENT DOCUMENTS 1,515,277 A 11/1924 Root
1,534,803 A 4/1925 Moore
1,733,674 A 10/1929 Leiman
2,073,636 A 3/1937 Holoubek
2,076,407 A 4/1937 Mandell
2,281,854 A 5/1942 Miller, Jr.
2,314,338 A 3/1943 Graves
2,317,651 A 4/1943 Talbot
2,324,670 A 7/1943 Bergen
2,348,377 A 5/1944 Goodyear
2,371,173 A 3/1945 Hothersall
2,409,655 A 10/1946 Annen
2,568,697 A 9/1951 Amberg
2,569,851 A 10/1951 Farrell
2,608,341 A 8/1952 Eckman
2,760,629 A 8/1956 Thagard, Jr.
2,795,366 A 6/1957 Magill
2,832,514 A 4/1958 O'Connor
2,891,713 A 6/1959 O'Neil
2,898,025 A 8/1959 Walker
2,948,454 A 8/1960 Gillmore
3,042,285 A 7/1962 Smith
3,042,288 A 7/1962 Carpenter, Sr.
3,049,277 A 8/1962 Shappell
3,101,885 A 8/1963 Walsh
3,109,576 A 11/1963 Karl
3,195,763 A 7/1965 Fried et al.
3,195,799 A 7/1965 Denenberg
3,391,852 A 7/1968 Waldrop
3,401,824 A 9/1968 Rouse
3,402,876 A 9/1968 Kuchenbecker
3,409,206 A 11/1968 Slouka et al.
3,445,049 A 5/1969 Carpenter, Jr.
3,506,183 A 4/1970 Turpin et al.
3,655,111 A 4/1972 Surerus
3,669,346 A 6/1972 Leezer et al.
3,696,987 A 10/1972 Schuff
3,940,496 A 2/1976 Turpin et al.
4,078,686 A 3/1978 Karesh
4,091,929 A 5/1978 Krane
4,091,984 A 5/1978 McFarland
4,198,901 A 4/1980 Knudsen
4,207,725 A 6/1980 Smith
4,210,618 A 7/1980 Piltz
4,495,209 A 1/1985 Whiteside
4,533,063 A 8/1985 Buchner et al.
4,556,152 A 12/1985 Bogren
4,606,462 A 8/1986 Bogren
4,621,736 A 11/1986 Roccaforte
4,632,298 A 12/1986 Schellengerg
4,720,038 A 1/1988 Shepard
4,736,870 A 4/1988 Christensson
4,804,101 A 2/1989 Heath
4,850,503 A 7/1989 Larsson
4,865,203 A 9/1989 Ueda
4,883,193 A 11/1989 Christensson
4,888,222 A 12/1989 Gibbons
4,921,121 A 5/1990 Duvander et al.
4,930,682 A 6/1990 Gordon et al.
5,407,107 A 4/1995 Smith
5,487,506 A 1/1996 Drummond et al.
5,511,680 A * 4/1996 Kinne ..... B65D 17/4011 220/791
5,514,394 A 5/1996 Lenahan
5,566,529 A * 10/1996 Sireix ..... B65D 3/262 53/449
5,617,705 A 4/1997 Sanfilippo et al.
5,641,118 A 6/1997 Benham
5,685,480 A 11/1997 Choi
5,752,646 A 5/1998 Sandstrom
5,803,294 A 9/1998 Bello et al.
5,820,016 A 10/1998 Stropkay
5,897,019 A 4/1999 Stropkay
5,950,917 A 9/1999 Smith
6,047,878 A * 4/2000 Lowry ..... B65D 3/262 229/125.05
6,092,717 A 7/2000 Lowry
6,165,114 A 12/2000 Stahlecker et al.
6,251,203 B1 6/2001 Vala et al.
6,325,232 B1 * 12/2001 Luttmann ..... B65D 17/402 220/672
6,415,940 B1 7/2002 Brabson, II
6,450,351 B1 9/2002 Thompson
6,644,541 B2 11/2003 Stewart
6,761,279 B1 7/2004 Martin et al.
7,169,418 B2 1/2007 Dalton
7,201,714 B2 4/2007 Zoeckler et al.
7,370,788 B1 5/2008 Otani et al.
7,703,625 B2 4/2010 Westphal
7,757,879 B2 7/2010 Schuetz
7,798,319 B1 9/2010 Bried
8,025,171 B2 9/2011 Cassol
8,220,701 B2 7/2012 Fontaine et al.
8,317,671 B1 11/2012 Zoeckler
8,403,819 B2 3/2013 Zoeckler
8,403,820 B2 3/2013 Zoeckler
8,684,224 B2 4/2014 House
8,915,395 B2 12/2014 Gersovitz
9,387,963 B2 7/2016 McBroom
9,718,574 B2 8/2017 Sireix
9,815,579 B2 11/2017 Larsson et al.
9,821,527 B2 11/2017 Hagelqvist
9,957,081 B2 5/2018 Gayer
9,975,305 B2 5/2018 Strand et al.
10,370,158 B2 8/2019 Herlin et al.
10,730,660 B2 8/2020 Herlin et al.
10,736,468 B2 8/2020 Herlin et al.
10,787,280 B2 9/2020 Herlin et al.
11,111,062 B2 9/2021 Herlin et al.
11,192,688 B2 12/2021 Herlin et al.
2002/0107127 A1 8/2002 Buisson
2002/0130126 A1 9/2002 Rosenberg
2003/0111522 A1 6/2003 Deering et al.
2003/0183540 A1 10/2003 Onishi
2004/0050437 A1 3/2004 Engel et al.
2004/0142133 A1 7/2004 De Coninck
2004/0206052 A1 10/2004 Shean
2004/0238553 A1 12/2004 Lane et al.
2005/0051461 A1 3/2005 Bryant
2005/0173501 A1 8/2005 Jones
2005/0189406 A1 9/2005 Welchel et al.
2005/0190995 A1 9/2005 Koyanagi
2005/0223680 A1 10/2005 Sireix
2005/0252952 A1 11/2005 Nomula
2006/0057315 A1 3/2006 De Coninck et al.
2006/0124719 A1 6/2006 Mannlein
2006/0254942 A1 11/2006 Cargile
2006/0257534 A1 11/2006 Maddock
2006/0289542 A1 12/2006 Schedl
2007/0090105 A1 4/2007 Elgebrant
2007/0145001 A1 6/2007 Tilto
2007/0157577 A1 7/2007 Buisson
2007/0170236 A1 7/2007 Rasanen
2007/0234667 A1 10/2007 Lubker et al.
2007/0235512 A1 10/2007 Drummond
2008/0041861 A1 2/2008 Crawford et al.
2008/0110896 A1 5/2008 Westphal
2008/0156805 A1 7/2008 Perry et al.
2008/0156808 A1 7/2008 Perry et al.
2009/0039078 A1 2/2009 Sanfilippo et al.
2009/0177179 A1 7/2009 Engelbrecht
2009/0236346 A1 9/2009 Hofeldt et al.
2009/0314775 A1 12/2009 Dietrich et al.

(56) References Cited

U.S. PATENT DOCUMENTS

| | | | | |
|---|---|---|---|---|
| 2010/0018883 | A1 | 1/2010 | Patel | |
| 2010/0065557 | A1 | 3/2010 | Gersovitz | |
| 2010/0108670 | A1 | 5/2010 | Perry et al. | |
| 2010/0133127 | A1 | 6/2010 | Jenner | |
| 2010/0140129 | A1 | 6/2010 | Sanfilippo | |
| 2010/0142862 | A1 | 6/2010 | Sam | |
| 2010/0180553 | A1 | 7/2010 | Tilton | |
| 2010/0270301 | A1 | 10/2010 | Cronin | |
| 2010/0308044 | A1 | 12/2010 | Perry et al. | |
| 2010/0308065 | A1 | 12/2010 | Vandamme et al. | |
| 2010/0308066 | A1 | 12/2010 | Perry et al. | |
| 2011/0006066 | A1 | 1/2011 | Vandamme et al. | |
| 2011/0240666 | A1 | 10/2011 | Mihaylov | |
| 2011/0253725 | A1 | 10/2011 | Killian | |
| 2012/0103353 | A1 | 5/2012 | Sebastian et al. | |
| 2012/0125932 | A1 | 5/2012 | Sierra-Gomez | |
| 2012/0298733 | A1 | 11/2012 | Xu et al. | |
| 2013/0029823 | A1 | 1/2013 | Zoeckler | |
| 2013/0048125 | A1 | 2/2013 | Hoffman et al. | |
| 2013/0092312 | A1 | 4/2013 | Cassoni | |
| 2013/0186901 | A1 | 7/2013 | Lejon et al. | |
| 2014/0109522 | A1 | 4/2014 | Sanfilippo | |
| 2014/0215973 | A1 | 8/2014 | Hagelqvist | |
| 2014/0262903 | A1 | 9/2014 | Mitten | |
| 2014/0287901 | A1 | 9/2014 | Hagelqvist | |
| 2015/0038309 | A1 | 2/2015 | Hoffman et al. | |
| 2015/0041470 | A1 | 2/2015 | Huffer et al. | |
| 2015/0099616 | A1 | 4/2015 | Chapman et al. | |
| 2015/0148208 | A1* | 5/2015 | Sireix | B65B 7/164 493/93 |
| 2015/0158632 | A1 | 6/2015 | Wilhelm | |
| 2016/0000270 | A1 | 1/2016 | Wiggins et al. | |
| 2016/0137377 | A1 | 5/2016 | Tracy | |
| 2017/0073142 | A1 | 3/2017 | Loomis et al. | |
| 2017/0247159 | A1 | 8/2017 | Hansen | |
| 2017/0283136 | A1 | 10/2017 | Branyon | |
| 2017/0297769 | A1 | 10/2017 | Gersovitz | |
| 2018/0016038 | A1 | 1/2018 | Herlin et al. | |
| 2018/0022505 | A1 | 1/2018 | Herlin et al. | |
| 2018/0170613 | A1 | 6/2018 | Hu | |
| 2018/0194527 | A1 | 7/2018 | Sasaki et al. | |
| 2018/0229907 | A1 | 8/2018 | Gayer | |
| 2018/0237206 | A1 | 8/2018 | Jobe | |
| 2018/0311940 | A1 | 11/2018 | Toft et al. | |
| 2019/0127100 | A1 | 5/2019 | Herlin et al. | |
| 2019/0127107 | A1* | 5/2019 | Herlin | B65D 3/14 |
| 2019/0135508 | A1 | 5/2019 | Sunning et al. | |
| 2019/0256230 | A1* | 8/2019 | Holka | B65B 1/02 |
| 2021/0070520 | A1 | 3/2021 | Huffer | |
| 2021/0206544 | A1 | 7/2021 | Holka et al. | |
| 2022/0135260 | A1 | 5/2022 | Larsson | |
| 2022/0363427 | A1 | 11/2022 | Andersson | |
| 2023/0054953 | A1 | 2/2023 | Graham | |

FOREIGN PATENT DOCUMENTS

| | | | |
|---|---|---|---|
| CN | 1189804 | A | 8/1998 |
| CN | 1914096 | A | 2/2007 |
| CN | 2915695 | Y | 6/2007 |
| CN | 101391493 | A | 3/2009 |
| CN | 201338810 | | 11/2009 |
| CN | 101754912 | | 6/2010 |
| CN | 102190118 | A | 9/2011 |
| CN | 101670909 | B | 1/2012 |
| CN | 102991764 | A | 3/2013 |
| CN | 103895952 | A | 7/2014 |
| CN | 103979180 | A | 8/2014 |
| CN | 104812680 | A | 7/2015 |
| CN | 107108068 | A | 8/2017 |
| CN | 206954829 | U | 2/2018 |
| CN | 109153475 | A | 1/2019 |
| CN | 208559788 | U | 3/2019 |
| DE | 884862 | C | 7/1953 |
| DE | 3411371 | A1 | 10/1985 |
| DE | 10 2005 026903 | A1 | 8/2006 |
| DE | 10 2011 014 844 | A1 | 9/2012 |
| DE | 10 2014 000 543 | A1 | 7/2015 |
| EP | 0 013 132 | A1 | 7/1980 |
| EP | 0 062 929 | A2 | 10/1982 |
| EP | 0 094 359 | A2 | 11/1983 |
| EP | 0 104 548 | B1 | 6/1987 |
| EP | 0 312 513 | A2 | 4/1989 |
| EP | 0 370 982 | A1 | 5/1990 |
| EP | 0 611 703 | A2 | 8/1994 |
| EP | 0 820 936 | A2 | 1/1998 |
| EP | 1 052 181 | A1 | 11/2000 |
| EP | 1818259 | A2 | 8/2007 |
| EP | 1 842 792 | A1 | 10/2007 |
| EP | 1 842 792 | B1 | 10/2008 |
| EP | 1 035 025 | B1 | 3/2011 |
| EP | 2 716 551 | A1 | 4/2014 |
| EP | 2 719 637 | A1 | 4/2014 |
| EP | 2 731 874 | A1 | 5/2014 |
| EP | 2 927 132 | A1 | 10/2015 |
| EP | 3 085 636 | A1 | 10/2016 |
| EP | 3 095 600 | A1 | 11/2016 |
| EP | 3162553 | A1 | 5/2017 |
| EP | 3 409 470 | A1 | 2/2018 |
| EP | 3 342 720 | A1 | 7/2018 |
| EP | 3 442 875 | | 2/2019 |
| EP | 3 481 727 | | 5/2019 |
| EP | 3 546 387 | | 10/2019 |
| EP | 3 578 477 | | 12/2019 |
| FR | 1358396 | A | 4/1964 |
| FR | 828311 | A | 5/1983 |
| FR | 2716408 | A1 | 8/1995 |
| FR | 2 981 333 | | 4/2013 |
| FR | 2986514 | A1 | 8/2013 |
| FR | 3043069 | | 5/2017 |
| GB | 22536 | A | 10/1908 |
| GB | 190722536 | A | 10/1908 |
| GB | 1911 00947 | A | 12/1911 |
| GB | 819960 | A | 9/1959 |
| GB | 920354 | A | 3/1963 |
| GB | 998102 | A | 7/1965 |
| GB | 1038995 | A | 8/1966 |
| GB | 2 281 895 | A | 3/1995 |
| GB | 2 453 869 | A | 4/2009 |
| GB | 2526548 | A1 | 12/2015 |
| JP | S58216539 | A * | 12/1983 |
| JP | S5962435 | A | 4/1984 |
| JP | S60501305 | A | 8/1985 |
| JP | S61217350 | A | 9/1986 |
| JP | S6375 | A | 1/1988 |
| JP | H0285118 | A | 3/1990 |
| JP | H05-58640 | U | 8/1993 |
| JP | H09-99939 | A | 4/1997 |
| JP | H09-290822 | A | 11/1997 |
| JP | 3025434 | B2 | 3/2000 |
| JP | 2000-203612 | A | 7/2000 |
| JP | 2001-030383 | | 2/2001 |
| JP | 2003-231191 | | 8/2003 |
| JP | 2004-001884 | A | 1/2004 |
| JP | 2004-026197 | A | 1/2004 |
| JP | 2004018100 | A | 1/2004 |
| JP | 2004-155478 | A | 6/2004 |
| JP | 2004-315094 | A | 11/2004 |
| JP | 2004-535993 | | 12/2004 |
| JP | 2005-041515 | | 2/2005 |
| JP | 2005-219319 | | 8/2005 |
| JP | 2005-333802 | | 12/2005 |
| JP | 3843510 | B2 | 11/2006 |
| JP | 2007-145415 | A | 6/2007 |
| JP | 2010-284866 | A | 12/2010 |
| JP | 2015-174690 | | 10/2015 |
| JP | 2016-084169 | A | 5/2016 |
| JP | 2016-088524 | A | 5/2016 |
| JP | 2016-179849 | A | 10/2016 |
| JP | 2017-074951 | A | 4/2017 |
| JP | 2019-137067 | | 8/2019 |
| JP | 6596835 | B2 | 10/2019 |
| JP | 2020-039532 | A | 3/2020 |
| KR | 10-2007-0113467 | | 11/2005 |

(56) References Cited

FOREIGN PATENT DOCUMENTS

| | | | | |
|---|---|---|---|---|
| RU | 2 188 783 | C2 | 9/2002 | |
| SE | 453821 | B | 3/1988 | |
| SE | 1651162 | A1 | 3/2018 | |
| SU | 1433404 | A3 | 10/1988 | |
| WO | WO 84/04511 | A1 | 11/1984 | |
| WO | WO 87/03536 | A1 | 6/1987 | |
| WO | WO 91/14623 | A1 | 10/1991 | |
| WO | WO 03/039201 | | 5/2003 | |
| WO | WO 2004/060767 | A1 | 7/2004 | |
| WO | WO 2005/032959 | A1 | 4/2005 | |
| WO | WO 2005/075314 | A2 | 8/2005 | |
| WO | WO 2006/068585 | A1 | 6/2006 | |
| WO | WO 2009/130043 | | 10/2009 | |
| WO | WO 2020/211939 | A1 | 10/2010 | |
| WO | WO 2011/052507 | A1 | 5/2011 | |
| WO | WO 2013/009227 | A1 | 1/2013 | |
| WO | WO 2013/057392 | A1 | 4/2013 | |
| WO | WO 2013/109174 | A1 | 7/2013 | |
| WO | WO 2014/062119 | A1 | 4/2014 | |
| WO | WO 2015/145600 | | 10/2015 | |
| WO | WO 2015/145601 | | 10/2015 | |
| WO | WO 2015/187004 | A1 | 12/2015 | |
| WO | WO 2014/011938 | A2 | 1/2016 | |
| WO | WO 2016/030071 | A1 | 3/2016 | |
| WO | WO 2016/034462 | A1 | 3/2016 | |
| WO | WO 2016/126191 | A1 | 8/2016 | |
| WO | WO 2016/126193 | A1 | 8/2016 | |
| WO | WO-2017180056 | A1 * | 10/2017 | ..... B65B 1/02 |
| WO | WO 2018/009128 | A1 | 1/2018 | |
| WO | WO 2018/009130 | A1 | 1/2018 | |
| WO | WO 2018/009134 | A1 | 1/2018 | |
| WO | WO 2018/009136 | A1 | 1/2018 | |
| WO | WO 2018/009138 | A1 | 1/2018 | |
| WO | WO 2018/217156 | A1 | 11/2018 | |
| WO | WO 2019/068384 | A1 | 4/2019 | |
| WO | WO 2019/226097 | A1 | 11/2019 | |
| WO | WO 2020/261170 | A1 | 12/2020 | |

OTHER PUBLICATIONS

International Search Report for PCT/SE2020/051184 dated Jan. 12, 2021. 6 pgs.

Machine Translation of WO 2019/068384 A1 (2019).

Notification of the First Office Action for Chinese Application No. 2020800858726 dated May 15, 2024 with English translation.

Search Report for Chinese Application No. 2020800858726 dated May 13, 2024 with English translation.

* cited by examiner

METHOD OF PRODUCING A PACKAGING CONTAINER, A PACKAGING CONTAINER AND A CURLING TOOL

CROSS-REFERENCE TO RELATED APPLICATIONS

The present application is a national phase entry under 35 U.S.C. § 371 of International Application No. PCT/SE2020/051184, filed Dec. 9, 2020, which claims priority from Swedish Patent Application No. 1951440-5, filed Dec. 12, 2019, the disclosures of which are hereby incorporated herein by reference.

TECHNICAL FIELD

The present disclosure pertains to a method of producing a paperboard packaging container, a paperboard container produced by the method and a curling tool.

BACKGROUND

In the area of disposable containers for products such as infant formula, tobacco, detergents, etc. there is an ongoing need of diminishing the carbon footprint of such products, by minimizing the resource use for the disposable containers as well as making the containers recyclable. The disposable containers referred to herein are composite containers having a tubular body which is made from a laminate sheet material comprising a carton layer, i.e. a layer made predominantly from cellulosic fibres. The upper and lower end edge of the container may include a plastic rim connected to the edges of the packaging container. This provides the packaging containers with a pleasant and neat appearance and the container top or bottom may also be more wear resistant. The bottom of the container may alternatively be made from a folded-in end portion of the tubular body or may be a bottom disc which is attached to the tubular body at the bottom end. The appearance may however for such packaging containers be somewhat less attractive and less wear resistant at the bottom end of the packaging container.

To improve the appearance and stability of the packaging container bottom or upper end, an end portion of the container body wall may be curled inwardly providing a curled bottom or upper edge.

An object of the present disclosure is to improve the curled end edge(s) of paperboard packaging container.

SUMMARY

According to a first aspect, the present disclosure relates to a method of forming a paperboard packaging container from a rectangular body blank including the following steps;

a) providing a rectangular body blank having a first side edge and a second side edge;

b) forming a tubular container body from the rectangular body blank, the container body having a first end with a first end opening and a second end with a second end opening and a container body wall extending in a height direction of the packaging container between the first end opening and the second end opening, the container body wall having an inner surface and an outer surface, a first end edge and a second end edge;

c) sealing together the first and the second side edge of the body blank;

d) closing the first end opening by pressing a paperboard disc into the first end opening, the paperboard disc having a peripheral flange being flexed towards the first end of the container body in the height direction of the paperboard packaging container, and sealing the peripheral flange of the paperboard disc to the inner surface of the container wall;

e) pressing the first end of the tubular container body into a curl forming portion of a curling tool, the curl forming portion comprising a tool inner surface having three or more spaced apart protuberances, thereby curling the first end of the container body wall inwardly forming a first curled edge comprising a bent edge portion and an inner portion, and providing the inner portion of the first curled edge with three or more spaced apart indentations along a circumference of the tubular container body, the indentations being formed by the spaced apart protuberances of the tool inner surface;

f) filling the packaging container with bulk solids; and g) closing the second end opening;

wherein steps g) and subsequently step f) could alternatively be performed after step c).

The curled first edge may be a curled bottom edge, meaning that the first end opening is a bottom end opening and that the paperboard disc is a bottom disc.

The curled first edge may be a curled upper edge, meaning that the first end opening is an upper end opening and that the paperboard disc is a top disc.

A stable upper and/or bottom container edge may be of importance for providing an enhanced stackability for the packaging container during transport and storage.

The method of producing a paperboard container according to the present invention may result in a lower contact surface of the curled edge, i.e. the surface being in contact with for example a shelf or the like. The fact that curled edge is made with a sharper bend than in previous known curling operations renders the curled edge more distinct and smaller, thereby the reducing the risk for a soiled and damaged curled bottom edge. The stability of the packaging container may also be improved. If the first edge is an upper edge the fact that the upper edge is more distinct and smaller enhances the stackability and the wear resistance of the edge. A distinct and smaller end edge also provides the packaging container with an improved appearance.

Instead of attaching a plastic rim to the bottom edge and/or to the upper edge of the packaging container and thereby including plastic components to the packaging container, a stable packaging container bottom and/or top may be obtained by forming of a curled bottom and/or upper edge by folding or rolling the bottom end/upper end of the container body wall inwardly, thereby also avoiding the need for plastic components which renders the recycling of the packaging container more difficult. It has however been found by the present inventors that the conventional curled bottom edge and/or curled upper edge may not be as neat as desired due to the relatively rigid and thick paperboard material structure. Curled edges has been found by the present inventors not to set properly, and has a tendency to spring-back somewhat after formation.

When forming the curled edge, the first end of the tubular container body is being pressed into the curl forming portion, such as a circumferential track, of the curling tool. The first end of the tubular container body bends by following an outer surface of the curl forming portion until the first end of the tubular container body reaches a bottom surface and bends inwardly following the contour of the bottom surface and folds itself against the tool inner surface. By using a curling tool according to the present disclosure and by pressing the inner portion of the curled edge against the protuberances, the fibres in the carton structure layer breaks rendering the paperboard material less rigid and the curling more controlled, thereby providing a more distinct curled edge. The three or more spaced apart protuberances at the tool inner surface will provide the inner portion of the first curled edge with three or more spaced apart indentations along a circumference of the tubular container body. The indentations will, in addition to the breaking of the fibre structure, flatten the inner portion of the curled edge thereby preventing an uncurling of the curled edge over time and provide a neatly curled bottom edge around the circumference of the packaging container.

The curl forming portion may comprise a tool inner surface having four or more spaced apart protuberance, or five or more spaced apart protuberances. The curl forming portion may comprise a tool inner surface having from six or more spaced apart protuberance, such as from eight to fifty spaced apart protuberance.

The curl forming portion may be a U-shaped track, the outer contour of the curl forming portion having essentially same footprint as a container body first end such that a container body first end fit into the curl forming portion and wherein the tool inner surface may be an inner surface of the curl forming portion. By "essentially the same" is intended that there may be a difference of from 0 to 3 mm between and along the footprint of the container body first end and the footprint of the curl forming portion.

As used herein, a paperboard material is a sheet material predominantly made from cellulose fibers or paper fibers. The sheet material may be provided in the form of a continuous web or may be provided as individual sheets of material. The paperboard material may be a single ply or multi ply material and may be a laminate comprising one or more layers of materials such as polymeric films and coatings, metal foil, etc. The polymeric films and coatings may include or consist of thermoplastic polymers. The paperboard material may be coated, printed, embossed, etc. and may comprise fillers, pigments, binders and other additives as known in the art. The paperboard materials as disclosed herein may also be referred to as cardboard or carton materials.

In step c) the sealing together of the first and the second side edge of the body blank may be made by sealing the border regions along the first and the second side edges by means of a sealing strip and/using gluing or welding. The sealing together of the first and second side edge may also be made by overlapping of the edges and by using gluing or welding. Welding of the edges are the preferred method in each of these two variants. The welding may be high frequency induction welding.

The tubular container body may be formed to have a three or more wall portions being connected by corner portions. The tubular container body may be formed to have four or five wall portions being connected by corner portions. Each of the wall portions may comprise one or more spaced apart indentations arranged in the inner portion of the first curled edge, such as for example two, three, four or five spaced apart indentations arranged in the inner portion of the first curled edge. The corner portions may be free from indentations. The corner portions of the tubular body may be curved corner portions.

The tubular body may alternatively have a circular cross-section. The tubular body may also have an essentially square, triangular or oval cross-section. By essentially square and triangular cross-sections include cross-sections having curved corner portions.

If the side edges are sealed by means of a sealing strip, it may preferably be welded to the inside surface of the tubular body by means of high frequency induction welding. Application of container components such as a top sealing member, a bottom disc and a top rim may be performed using an attachment unit comprising a welding unit, such as a high frequency welding unit, which is configured to fasten the component to the tubular body during production of the composite container. The welding unit may comprise an inductive welding energy generator for softening or melting a weldable layer that forms part of the tubular body and/or the applied container component. The sealing strip may also be adhesively attached to the inside surface of the tubular body, the attachment unit may in such case comprise a gluing unit. The sealing strip may of course be attached by any other suitable means. The sealing strip may for example be made of a laminate film including an aluminium layer, a polyethylene layer and a polyester layer.

The paperboard disc may be attached to the tubular body by welding the peripheral flange of the paperboard disc to the inside surface of the tubular body. The peripheral flange is created by folding an edge portion of the paperboard disc out of the plane of the paperboard disc and into alignment with the inside surface of the tubular body. The paperboard disc is applied at a distance from the first end edge of the tubular body to allow forming the curled second edge by curling the first end.

Step e) may include folding or rolling the second end of the container body wall inwardly and over the peripheral flange of the paperboard disc. This may provide an improved stability to the curled first edge as the curled edge in a transverse direction has an increased thickness. Additionally, as the inner portion of the curled edge is provided over the peripheral flange, the edge of the peripheral flange is covered by the curled edge and may not interfere with the bottom or upper edges of another packaging container when being stacked. Therefore, the stackability of the paperboard packaging container is improved.

The method may comprise a step h) of pressing the second end of the tubular container body into the curl forming portion of the curling tool, thereby curling the second end of the container body wall inwardly forming a second curled edge comprising a bent edge portion and an inner portion, and providing the inner portion of the first curled edge with three or more spaced apart indentations along a circumference of the tubular container body, the indentations being formed by the spaced apart protuberances of the tool inner surface.

For the method of forming a paperboard packing container having both a first and a second curled end edge, the steps of forming the first curled edge may include all features disclosed for the method of forming the second curled edge. Similarly, for the packaging container including both a curled second edge and a curled first edge, the first curled edge may include some or all of the features disclosed for the second curled edge.

In a second aspect the present disclosure relates to a paperboard packaging container for bulk solids. The paperboard packaging container may be formed using the method as disclosed herein. The container comprises a tubular container body being made by a laminate sheet material comprising a carton substrate layer, a container bottom and a container lid. The container body extends in a height direction of the container from a first end to a second end and the tubular container body comprising a container body wall. The container body wall has an inner surface facing towards an inner compartment in the packaging container and an outer surface facing away from the inner compartment, a first end edge and a second end edge, a first end opening being closed with a paperboard disc. The paperboard disc has a peripheral flange being flexed towards the first end in the height direction and attached to the inner surface of the container body wall. The first end of the container body wall is curled inwardly providing a first curled edge comprising an edge portion and an inner portion. The container wall is in the inner portion of the first curled edge provided with three or more indentations being spaced apart along a circumference of the tubular container body.

A depth of each of the three or more indentations, as measured in a direction perpendicular to the height direction of the packaging container, is from 0.2 mm or more, such as from 0.5 mm or more, and up to 6 mm from the inner surface of the curl forming portion of the curled edge.

The inner portion of the curled edge may have a height of from 2 mm to 30 mm, as measured, in the height direction, from the edge portion of the curled edge and a distal edge of the inner portion of the curled edge, the distal edge of the inner portion corresponding to the second transverse edge of the body blank.

The tubular container body may be formed to have a three or more wall portions being connected by corner portions. The tubular container body may be formed to have four or five wall portions being connected by corner portions. Each of the wall portions may comprise one or more spaced apart indentations arranged in the inner portion of the first curled edge, such as for example two, three, four or five indentations spaced apart indentations arranged in the inner portion of the first curled edge. The corner portions may be free from indentations. The corner portions of the tubular body may be curved corner portions.

The tubular body may alternatively have a circular cross-section. The tubular body may also have an essentially square, triangular or oval cross-section.

The first end opening may be a bottom end opening, the paperboard disc then being a bottom disc and the first curled edge being a curled bottom edge.

The first end opening may be an upper end opening, the paperboard disc being a top disc and the first curled edge being a curled upper edge.

The second end of the container body wall may be curled inwardly providing a second curled edge comprising an edge portion and an inner portion, the inner portion of the second curled edge may be provided with three or more indentations being spaced apart along a circumference of the tubular container body.

An example of a packaging container suitable for having both a curled upper end and a curled bottom end is disclosed in WO 2017/180056. The packaging container in this patent application is of the plug-in lid type, being formed of a paperboard top disc and the container wall and by cutting an at least partly circumferential cut along the circumference of the container body thereby separating an upper portion forming the plug-in lid.

The composite container as disclosed herein may comprise a top sealing member which is attached to the inside surface of the tubular body at a distance from the top end of the tubular body.

The packaging container may in step g) be provided with a top sealing member. The top sealing member may be an openable or peelable top sealing member, implying that it may be fully or partly removed by a user in order to provide initial access to an interior compartment of the composite container either by breaking a seal between the top sealing member and the inside surface of the tubular body, or by tearing or otherwise breaking the top sealing member itself.

The top sealing member may be gastight or gas-permeable. A gastight top sealing member may be manufactured from any material or material combination suitable for providing a gastight sealing of a compartment delimited by the sealing membrane, such as aluminium foil, silicon-coated paper, carton, plastic film, or laminates thereof. A gastight top sealing member is particularly advantageous when the contents in the composite container are sensitive to air and/or moisture.

The top sealing member may be attached to the tubular body by welding a peripheral flange of the top sealing member to the inside surface of the tubular body. As disclosed herein, the top sealing member is commonly a flexible component made from a laminate including an inductive layer, such as of one or more layers of metal foil, such as aluminium foil, and outer layers of thermoplastic polymeric material. The peripheral flange is created by folding an edge portion of the top sealing member out of the plane of the top sealing member and into alignment with the inside surface of the tubular body. The top sealing member is applied at a distance from the top end edge of the tubular body to allow for attachment of the top rim above the top sealing member. If the composite container comprises a scoop, a leaflet, or other supplementary item, the top sealing member may be applied at a sufficient distance from the top end edge of the tubular body to allow the item to be accommodated in a space formed between the top sealing member and an inside surface of the lid.

Depending on whether the top sealing member is applied from the upper end of the tubular body or from the bottom end of the tubular body, the flange of the top sealing member which is joined to the inside surface of the tubular body may be directed upward toward the container opening or downward, toward the bottom end of the composite container.

The top sealing member may constitute a transport seal and is provided in addition to the openable and closable lid, to keep the contents in the composite container fresh and protected against contamination up until a first opening of the composite container by a consumer.

A peelable top sealing member commonly takes the form of a flexible foil which may be provided with a grip tab or another gripping device for facilitating removal of the top sealing member.

The lid of the composite container as disclosed herein may be a part of a lid component, the lid component comprising the top rim and a lid part.

Alternatively, the lid may be a separate part of the composite container which can be completely removed when opening the composite container, such as a plug-in lid.

When the lid is part of a lid component, it may be connected to a top rim by means of a hinge. The hinge may be a live hinge, i.e. a bendable connection between the lid and the top rim or frame structure. A live hinge may be formed integrally with the lid and/or with the top rim or frame structure or may be a separately formed element which is attached to the lid and to the top rim or frame structure. Alternatively, the hinge may be a two-part hinge, with a first hinge part arranged on the lid and a second hinge part arranged on the top rim or frame structure.

The composite containers as disclosed herein are containers for dry or moist goods, often referred to as "bulk solids". Such products are non-liquid, generally particulate materials capable of being poured, scooped or taken by hand out of the cans. The containers are disposable containers, which are intended to be discarded after having been emptied of their contents.

A "particulate material" or "particulate product" should be broadly understood to include any material in the form of particles, granules, grinds, plant fragments, short fibres, flakes, seeds, pieces, etc. The particulate products which are suitable for packaging in the composite containers as disclosed herein are generally flowable non-liquid products, allowing a desired amount of the packaged product to be poured, scooped or taken by hand out of the composite container.

A composite container as disclosed herein may be a container for alimentary or consumable products such as infant formula, coffee, tea, rice, flour, sugar, rice, peas, beans, lentils, cereals, soup powder, custard powder, pasta, snacks, or the like. Alternatively, the packaged product may be non-alimentary, such as tobacco, detergent, dishwasher powder, fertilizer, chemicals, or the like.

The paperboard packaging container according to the second aspect may be formed by the method of forming a paperboard packaging container according to the first aspect.

According to a third aspect, the present disclosure relates to a curling tool for forming a curled edge on a paperboard packaging container. The curling tool is a curl plate having a curl forming portion in the form of a track having the shape of a closed loop configured for receiving a tubular container body upper or lower edge portion. The curl forming portion has an outer surface, a bottom surface and an inner surface. The curl plate has a first main side intended to face the paperboard packaging container when forming the curled edge. The curl forming portion is provided in the first main side and has a depth, as measured from the first main side to the bottom surface of the curl forming portion. The inner surface is provided with three or more protuberances being spaced apart along a circumference of the curl forming portion.

The protuberances extending into the curl forming portion in a direction perpendicular to a height direction of the packaging container when provided in the curl forming portion during formation of the curled edge.

The curl forming portion may be a U-shaped track, as seen in a cross-sectional view, having essentially the same footprint as a container body first end such that a container body first end fit into the U-shaped track and wherein the tool inner surface is an inner surface of the U-shaped track.

The curl forming portion may comprise a tool inner surface having 4 or more spaced apart protuberance, or 5 or more spaced apart protuberances. The curl forming portion may comprise a tool inner surface having from 6 or more spaced apart protuberance, such as from 8 to 50 spaced apart protuberance.

The three or more protuberances may protrude 0.2 mm or more from the inner surface of the curl forming portion.

The three or more protuberances may protrude 0.5 mm or more, or 1.5 mm or more, from the inner surface of the curl forming portion.

The depth of the curl forming portion may be from 5 mm up to 40 mm.

The depth of the curl forming portion may be from 5 mm up to 30 mm.

The three or more protuberances may have a diameter and may be arranged with a spacing between adjacent protuberances corresponding at least to the diameter of the protuberances. Optionally, the spacing between adjacent protuberances may be within the range of from 5 mm to 50 mm. Optionally, the spacing between adjacent protuberances may be within the range of from 5 mm to 20 mm.

Optionally the three or more protuberances may have a diameter within the range of from 5 mm to 20 mm.

The three or more protuberances may have a diameter within the range of from 2 mm to 10 mm.

The three or more protuberances may be formed by studs provided in the curl forming tool and along the circumference of the curl forming portion.

The three or more protuberances may be aligned at level with each other along the circumference of the curl forming portion.

The curling tool according to the third aspect may be a curling tool for use in the method of forming a paperboard packaging container according to the first aspect and for providing a paperboard packaging container according to the second aspect.

BRIEF DESCRIPTION OF THE DRAWINGS

The present invention will be further explained hereinafter by means of non-limiting examples and with reference to the appended drawings wherein.

DETAILED DESCRIPTION

It is to be understood that the drawings are schematic and that individual components, such as layers of materials are not necessarily drawn to scale. The steps in the method of forming a packaging container and the packaging container shown in the figures are provided as examples only and should not be considered limiting to the invention. Accordingly, the scope of the invention is determined solely by the scope of the appended claims.

Figure 1:
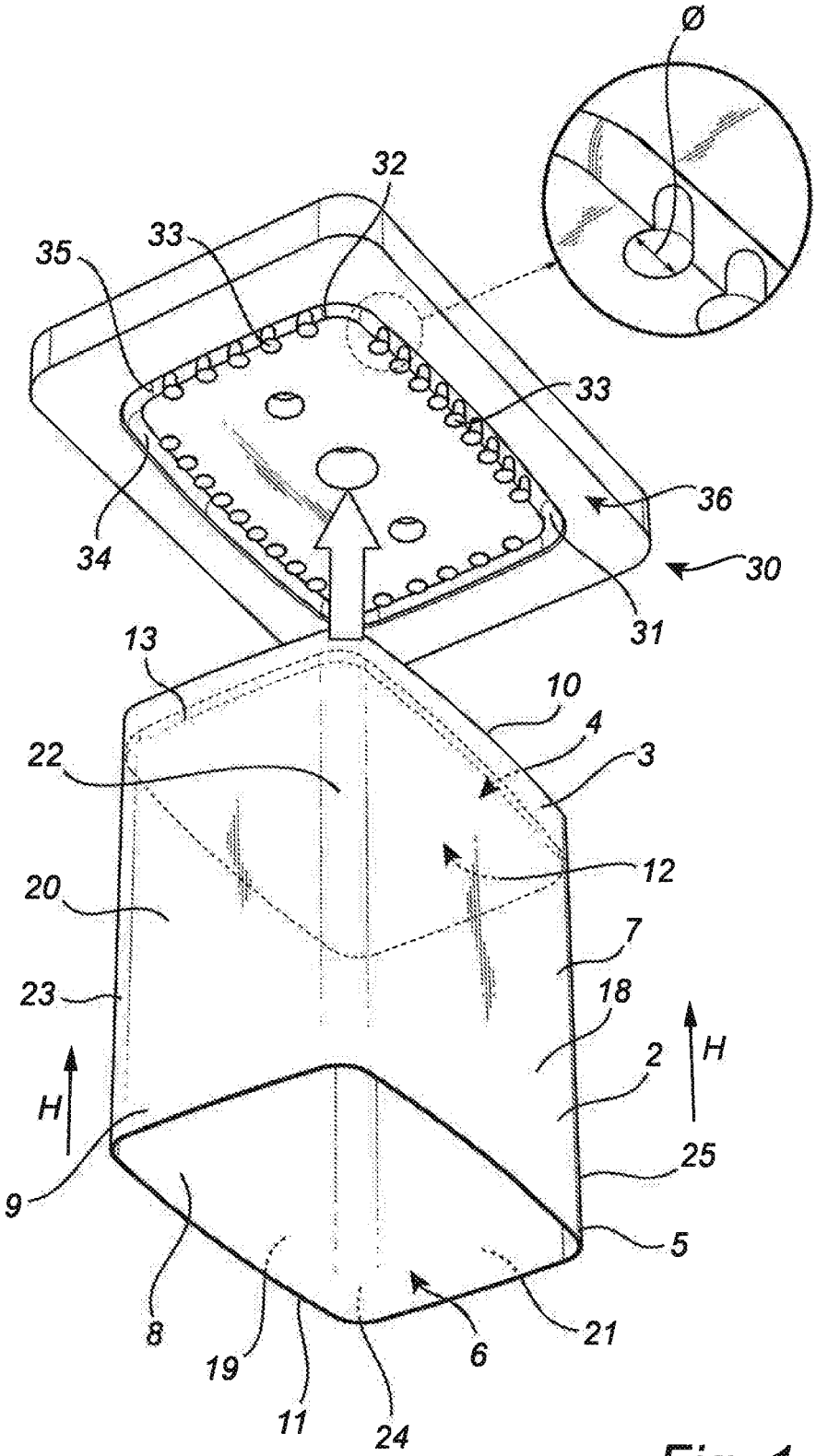
FIG. 1 illustrates a tubular container body and a curling tool according to the present invention prior to forming of a curled edge.

FIG. 1 illustrates a step in a method of forming a paperboard packaging container from a tubular container body 2. The tubular container body 2 has a first end 3 with a first end opening 4 and a second end 5 with a second end opening 6 and a container body wall 7 extending in a height direction H between the first end opening 4 and the second end opening 6. The container body wall 7 has an inner surface 8 and an outer surface 9, a first end edge 10 and a second end edge 11. In a first step (not shown) of the method according to the present disclosure the tubular container body 2 is formed by providing a body blank having a first side edge and a second side edge and forming the tubular container body by sealing together the first and second side edges of the body blank. The first end opening 4 is closed by pressing a paperboard disc 12 into the first end opening 4 (this method step not being shown). The paperboard disc 12 has a peripheral flange 13 being flexed towards the first end 3 of the container body 2 in the height direction H of the tubular container body 2. The peripheral flange 13 of the paperboard disc 12 is sealed to the inner surface 8 of the container wall 7. In this figure, the tubular container body 2 has a rectangular cross-section with a front wall portion 18, a rear wall portion 19, two side wall portions 20, 21, the wall portions 18, 19, 20, 21 being connected by curved corner portions 22, 23, 24, 25. As set out herein, it is to be understood that the packaging container may have any suitable cross-section FIG. 1 furthermore illustrates a curling tool 30 for forming a curled edge 14 (shown in FIG. 6) on a paperboard packaging container. The curling tool 30 is a curl plate having a curl forming portion 31 in the form of a U-shaped track having the shape of a closed loop configured for receiving the tubular container first end edge 3. In this FIG. 1 the curl forming portion has a modified rectangular shape with curved edge portions to match the cross-sectional shape of the container body 2. The curl forming portion 31 has an inner surface 32, an outer surface 34 and a curved bottom surface 35. The curl plate 30 has a first main side 36 intended to face the tubular container body 2 when forming the curled edge 14. The inner surface 32 is provided with a plurality of protuberances 33, protruding into the curl forming portion 31 from the inner surface 32 and being spaced apart along a circumference of the curl forming portion 31. The corner portions of the curl forming portion 31 are free from protuberances 33. A spacing between two adjacent protuberances 33 corresponds at least to a diameter Ø of the protuberances 33. The diameter Ø of each of the protuberances 33 may be within the range of from 2 mm to 20 mm, more preferably within the range of from 2 to 10 mm. The protuberances protrudes with a depth d of 1.5 mm or more from the inner surface 32 of the U-shaped track 31. The curl forming portion 31 has essentially the same footprint as the container body first end 3 and second end 5. In this figure the protuberances 33 are formed by studs provided in the curl plate 30 and along the circumference of the curl forming portion 31.

FIG. 1 illustrates the step after the first end opening 4 has been closed with the sealing disc 12. The tubular container body 2 and the curling tool 30 are brought together to introduce the first end 3 of the container body 2 into the curl forming portion 31.

Figure 2:
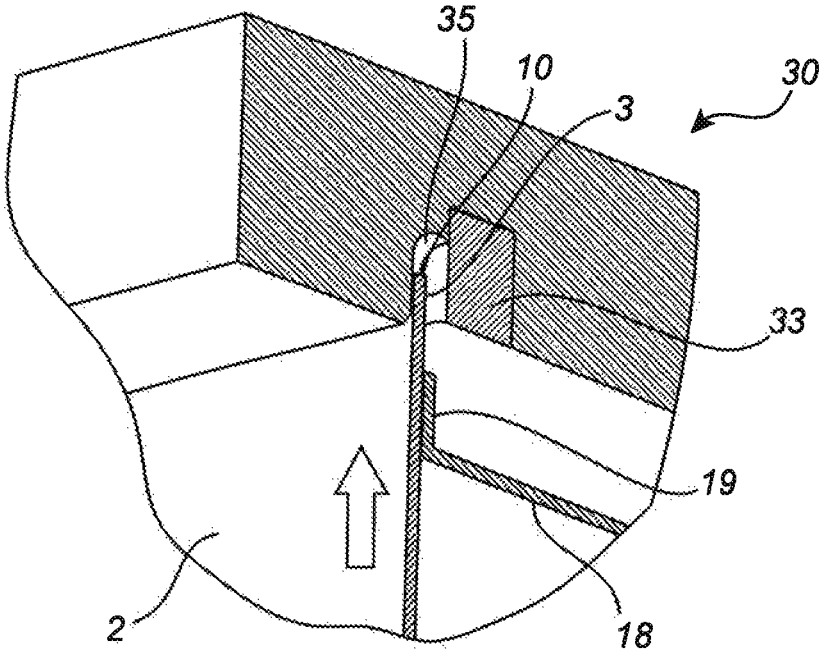
FIG. 2 illustrates pressing of a first end of a tubular container body into a curl forming portion of a curling tool.
Figure 3:
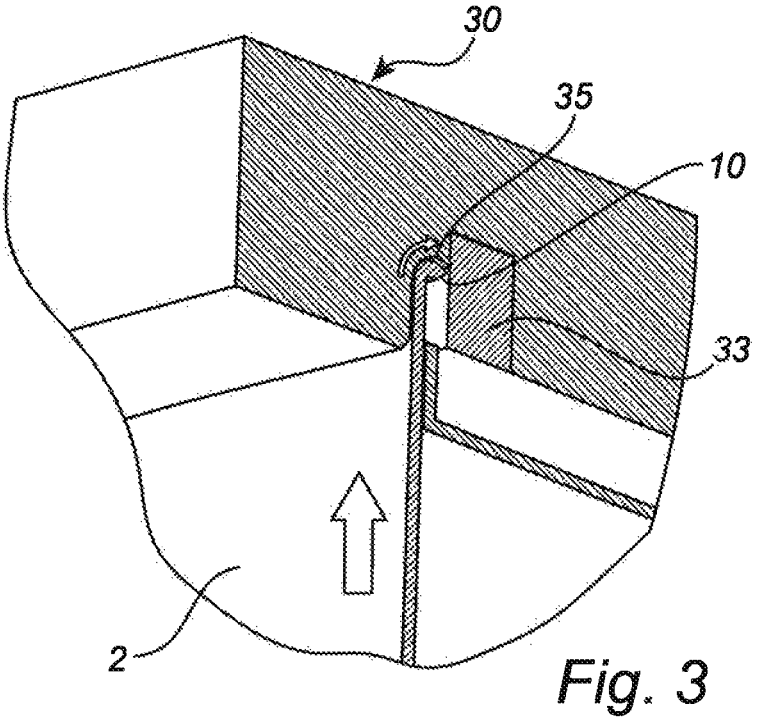
FIGS. 3-5 illustrate curling an end of a container body wall inwardly to form a curled edge.
Figure 4:
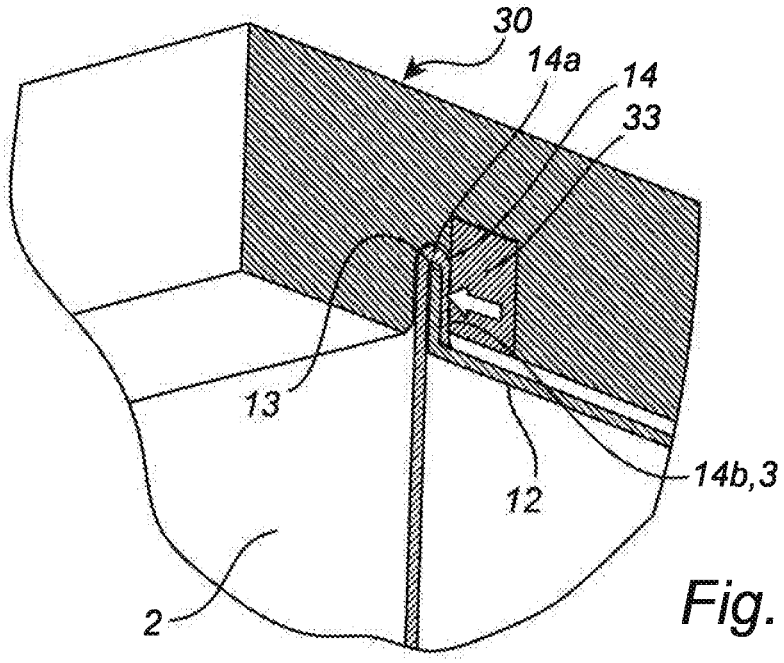
Figure 5:
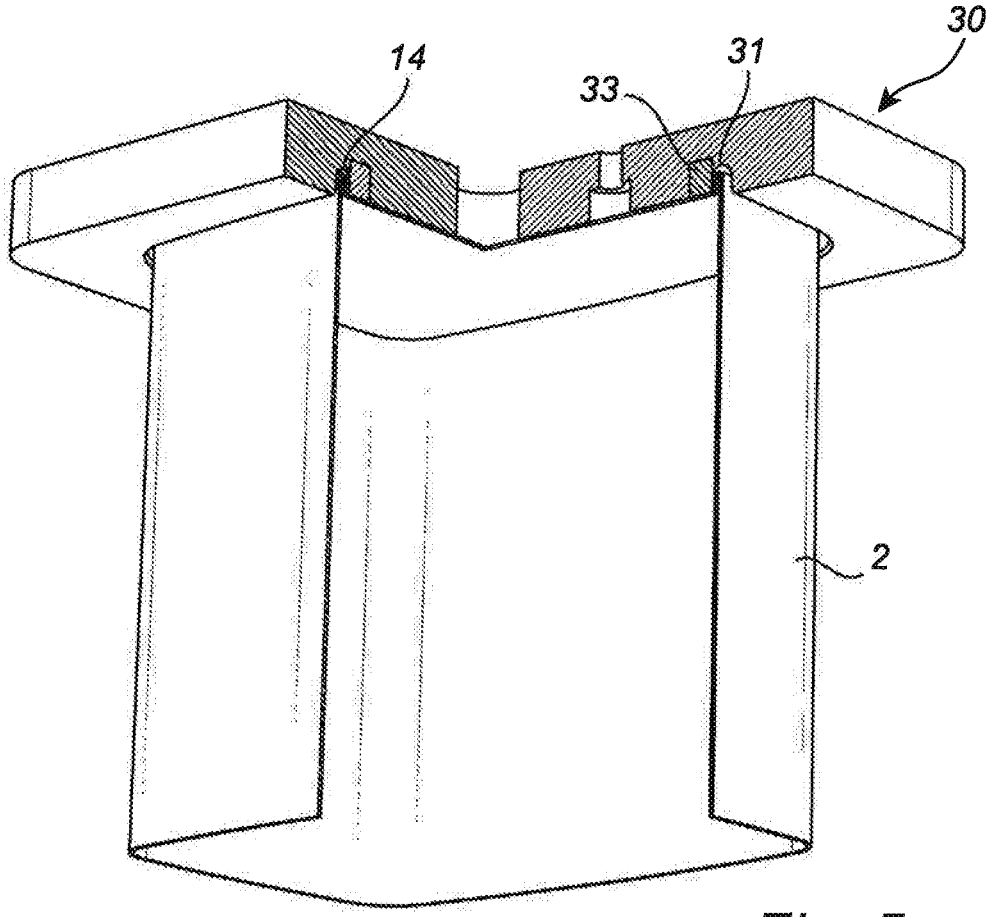

FIG. 2 illustrates when the first end 3 of the tubular container body 2 is pressed into the U-shaped track 31 of the curling tool 30. When the tubular container body 2 is pressed into the curling tool 30, the first end 3 of the tubular container body 2 is pressed towards the bottom surface 35 of the curl forming portion 31 and follows the curvature and bends together with the curved bottom surface 35, as illustrated in FIG. 3. When pressing the first end 3 further into the curling tool 30, the first end 3 completely bends and folds itself inwardly as illustrated in FIGS. 4 and 5, thereby forming the first curled edge 14 comprising a bent edge portion 14*a* and an inner portion 14*b*. When the tubular container body 2 is pressed into the curved bottom surface 35 of the curl forming portion 31 and bends inwardly, the inner portion 14*b* of the curled edge 14 presses against the inner surface 32 and against the spaced apart protuberances 33 as shown in FIGS. 4 and 5. In these figures the first end 3 of the tubular container body 2 is bent over and pressed against the peripheral flange 13 of the paperboard disc 12. Optionally, the paperboard disc 12 may be arranged at a greater distance to the first end edge 10 such that the curled edge just folds over itself. The spaced apart protuberances 33 protrude out and into the curl forming portion 31 and provide additional compression of the inner portion 14*b* of the bent edge portion 14. The protuberances 33 press into the paperboard material and deform the carton structure layer thereby rendering the paperboard material less rigid and the curled edge 14 becomes less bulky and more distinct. The protuberances 33 break the paperboard material perpendicular to the curling direction, causing the material to be less prone to spring-back and the curl to set in the desired configuration.

Figure 6:
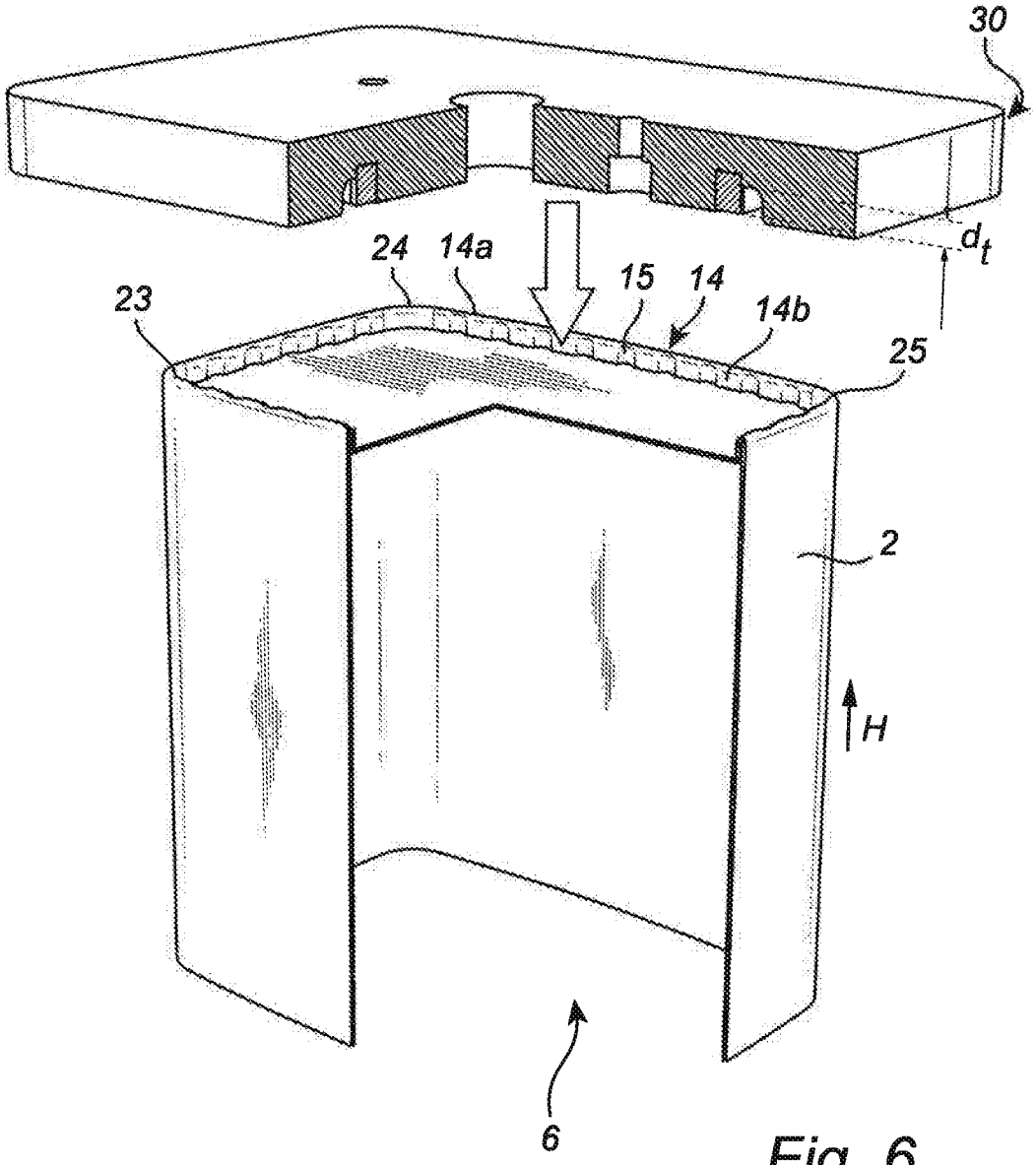
FIG. 6 illustrates a packaging container with a curled edge according to the present disclosure.

FIG. 6 illustrates the tubular container body 2 after formation of the first curled edge 14. Along a circumference of the tubular container body 2, the inner portion 14*b* of the first curled edge 14 is provided with spaced apart indentations 15. The depth d (shown in FIG. 1) of the indentations 15 may for example be within the range of from 0.2 mm to 6 mm. The corner portions 23, 24, 25 at the first end 3 of the tubular body 2 are free from indentations 15. Indentations 15 in these area may otherwise render the folding of the material in the corner portions 23, 24, 25 bulkier and less neat. The curl forming portion 31 may have a depth $d_r$ within the range of from 5 mm up to 40 mm, such as within the range of from 10 mm to 30 mm.

In a subsequent step, not shown herein, the tubular container body is turned such that the second end opening is directed upwardly and the packaging container is filled with bulk solids. The packaging container may optionally be sealed over the second end opening with a partly or fully removable transport closure being attached to the inner surface of the container body wall.

Figure 7:
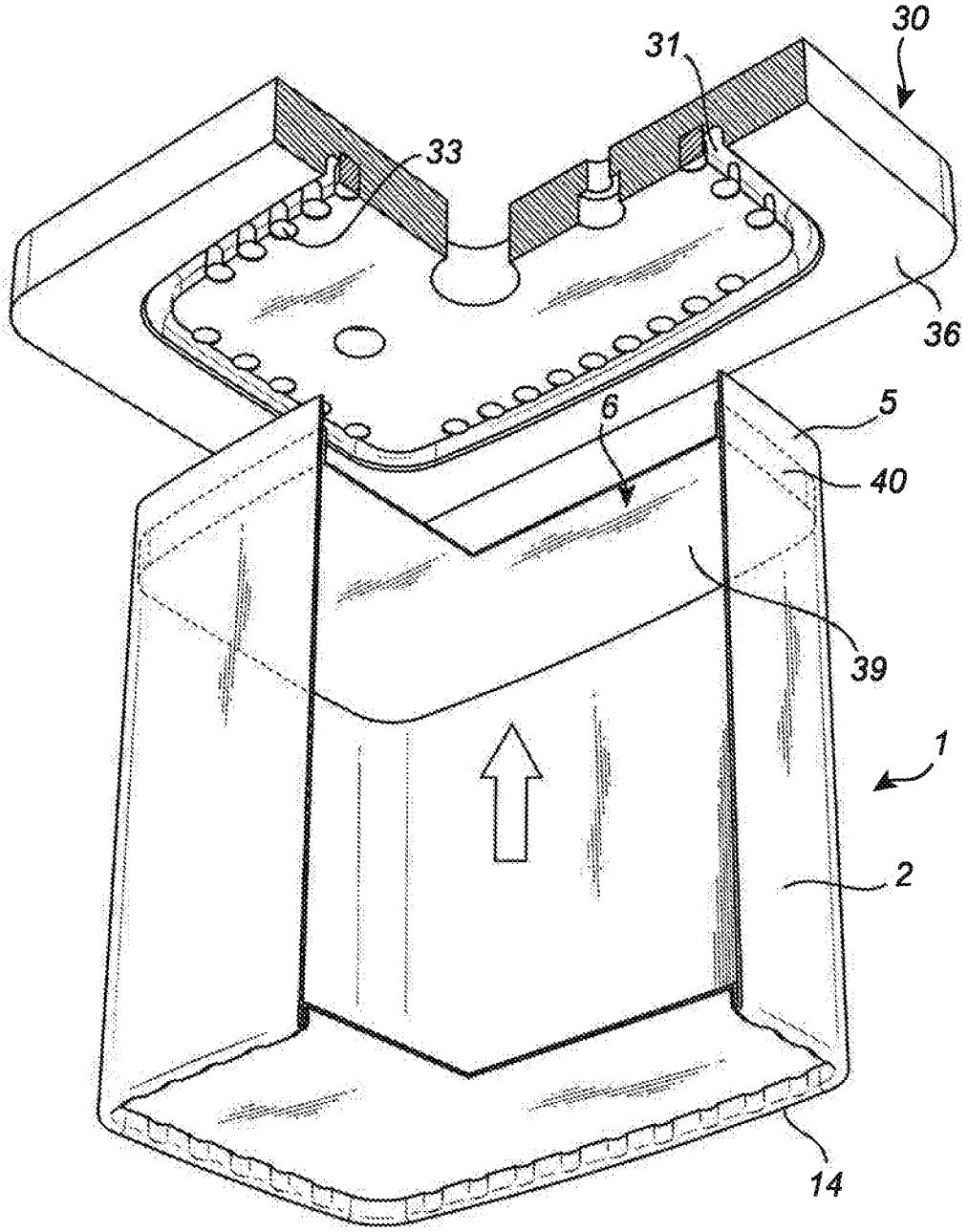
FIG. 7 illustrates an optional step of forming a second curled edge.

FIG. 7 illustrates an optional step of forming a packaging container comprising a second curled edge. Prior to this step the second end opening 6 has been closed at the second end of the container body 2 with a paperboard disc 39 having a peripheral flange 40 being flexed towards the second end 5 of the paperboard packaging container 1. In this optional step, the second end 5 of the tubular container body 2 is directed upwardly and is guided towards the main side 36 of the curling plate 30 to form a second curled edge 38 provided with indentations 41, similar to the first curled edge 14, by introducing the second end 5 into the curl forming portion 31 provided with the spaced apart protuberances 33 in the same way as when forming the first curled edge 14.

Figure 8:
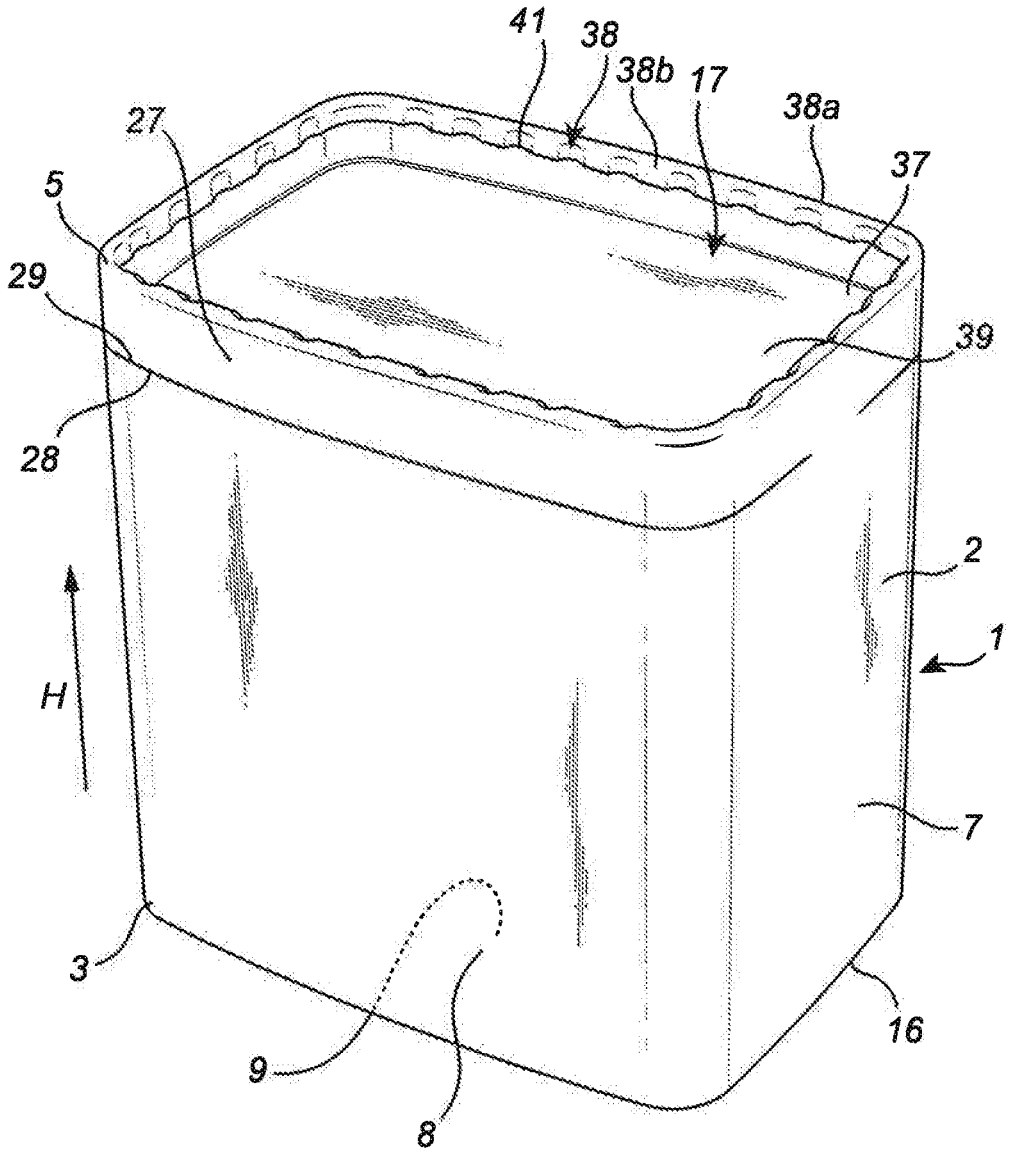
FIG. 8 illustrates a packaging container according to the present disclosure.

In FIG. 8, a paperboard packaging container 1 for bulk solids according to the present disclosure is illustrated and as produced according to the method illustrated in FIGS. 1-7. The packaging container 1 comprises the tubular container body 2 being made by a laminate sheet material comprising a carton substrate layer, a container bottom 16 and a container lid 17. The container body 2 extending in a height direction H of the container 1 from the first end 3, corresponding to the bottom end, to the second end 5, corresponding to the upper end. In a packaging container according to the present disclosure, the first end may correspond to either the upper end or the bottom end of the packaging container.

The tubular container body 2 comprises the container body wall 7, the container body wall 7 having the inner surface 8 facing towards an inner compartment in the packaging container 1 and the outer surface 9 facing away from the inner compartment. The lid 17 of the packaging container is a plug-in lid type. The lid 17 comprises an outer circumferential lid collar 27 having a lid abutment edge 28, adapted to abut against a container body abutment edge 29, and a lid plug-in portion 37. An example of this kind of lid-type is disclosed in WO 2017/180056. In this packaging container the container opening has been closed with an upper paperboard disc 39. The upper paper board disc and the tubular container body 2 being parts of the plug-in lid. The second end 5 of the tubular container body 2 thus forms the upper end of the packaging container 1 and is the second curled edge 38 provided with indentations 41 at an inner portion 38*b* of the second curled edge 38, thereby providing a distinct second bent edge portion 38*a*

The packaging container may be provided with a lid of any suitable kind. The lid may be of the removable kind, without any permanent connection to the container body. It is further to be understood that the closure arrangement as shown in FIG. 2 is non-limiting and that the bottom end as disclosed herein may be used for packaging containers having other types of closure arrangements such as closure arrangements wherein a lid cooperates with a reinforcement rim or with a frame structure of the container body to close and open the packaging container. The lid may be provided as a part of a lid component. A lid component comprises a rim to which the lid is connected with a hinge. The rim is attached to the container body and stabilizes the container opening. The lid component may be provided with features such as locking means for keeping the lid in a closed position, tamper evidence means, stacking means, etc. as known in the art. Lid components are usually formed by injection moulding of thermoplastic material.

The invention claimed is:

1. A method of forming a paperboard packaging container from a rectangular body blank, the method comprising the steps of;

a) providing a rectangular body blank having a first side edge and a second side edge;

b) forming a tubular container body from the rectangular body blank, the container body having a first end with a first end opening and a second end with a second end opening and a container body wall extending in a height direction of the packaging container between the first end opening and the second end opening, the container body wall having an inner surface and an outer surface;

c) sealing together the first side edge and the second side edge of the body blank;

d) closing the first end opening by pressing a paperboard disc into the first end opening, the paperboard disc having a peripheral flange being flexed towards the first end of the container body in the height direction of the paperboard packaging container, and sealing the peripheral flange of the paperboard disc to the inner surface of the container wall;

e) pressing the first end of the tubular container body into a curl forming portion of a curling tool, the curl forming portion comprising a tool inner surface having three or more spaced apart protuberances, thereby curling the first end of the container body wall inwardly forming a first curled edge comprising a bent edge portion and an inner portion, and providing the inner portion of the first curled edge with three or more spaced apart indentations along a circumference of the tubular container body, the indentations being formed by the spaced apart protuberances of the tool inner surface, wherein the spaced apart protuberances are spaced apart from one another along a circumference of the curl forming portion;

f) filling the packaging container with bulk solids; and g) closing the second end opening;

wherein steps g) and subsequently step f) could alternatively be performed after step c).

2. The method of forming a paperboard packaging container according claim 1, wherein the curl forming portion is a U-shaped track having the same footprint as the first end of the tubular container body such that the first end of the tubular container body fits into the curl forming portion and wherein the tool inner surface is an inner surface of the curl forming portion.

3. The method of forming a paperboard packaging container according to claim 1, wherein the method comprises a step h) of pressing the second end of the tubular container body into the curl forming portion of the curling tool, thereby curling the second end of the container body wall inwardly forming a second curled edge comprising a bent edge portion and an inner portion, and providing the inner portion of the first curled edge with three or more spaced apart indentations along a circumference of the tubular container body, the indentations being formed by the spaced apart protuberances of the tool inner surface.

4. The method of forming a paperboard packaging container according claim 1, wherein the pressing the first end of the tubular container body into the curl forming portion of the curling tool comprises pressing the first end of the tubular container body towards a curved bottom surface of the curl forming portion so that the first end of the tubular container body follows the curvature and bends together with the curved bottom surface and so that the first end of the tubular container body folds itself inwardly to form the first curled edge.

5. The method of forming a paperboard packaging container according claim 4, wherein the pressing the first end of the tubular container body into the curl forming portion of the curling tool further comprises further pressing the first end of the tubular container body into the curved bottom surface of the curl forming portion so that an inner portion of the first curled edge presses against an inner surface of the curl forming portion and against the spaced apart protuberances.

* * * * *